United States Patent [19]

Yoder

[11] Patent Number: 5,018,563

[45] Date of Patent: May 28, 1991

[54] MOBILE, EXTENDIBLE TABLE WITH TOOL MOUNT AND CARRIER

[76] Inventor: Thomas P. Yoder, 3855 Water Oakway, Doravalle, Ga. 30340

[21] Appl. No.: 422,525

[22] Filed: Oct. 17, 1989

[51] Int. Cl.[5] ..... B25H 1/00

[52] U.S. Cl. ..... 144/286 R; 144/1 R; 144/286 A; 144/287; 269/296

[58] Field of Search ..... 83/574; 144/1 R, 1 C, 144/285, 286 A, 287; 269/296

[56] References Cited

U.S. PATENT DOCUMENTS 4,515,191 5/1985 Felty ..... 144/1 C

*Primary Examiner*—W. Donald Bray
*Attorney, Agent, or Firm*—Harry I. Leon

[57] ABSTRACT

A mobile table having a variety of tool mounts that also serves as a carrier for workpieces. The table includes an offset frame having four fixed tubes and a pair of asymmetrical end pieces which support them. The four fixed tubes, which are parallel to each other, form the top of the table and serve as housing for four movable tubes.

The two outer fixed tubes house movable tubes which are rigidly connected to a support structure. The remaining two movable tubes are pivotally connected to the support structure and, once withdrawn from the fixed tubes, can be rotated into a vertical position. So rotated, they form legs for the support structure. One end of each of the two outer movable tubes, even during full extension, is retained within a fixed tube. The movable tubes and the support structure comprise an extension for the table which can be used to double its length.

Moreover, each of the asymmetrical endpieces includes two horizontal bars of equal length, two vertical columns of unequal length, and a brace. The longer vertical column is rigidly connected to the horizontal bars near the outside edge of the table. The shorter vertical column is situated near the middle of the table. Anchored by a short cross member to the longer vertical column, the brace extends upwardly from the second vertical column and forms a cantilever beam to support the upper horizontal bar. The asymmetrical endpieces themselves are so positioned that a large unobstructed space, useful for storing workpieces, is created on one side of the table.

15 Claims, 6 Drawing Sheets

Fig. 4.
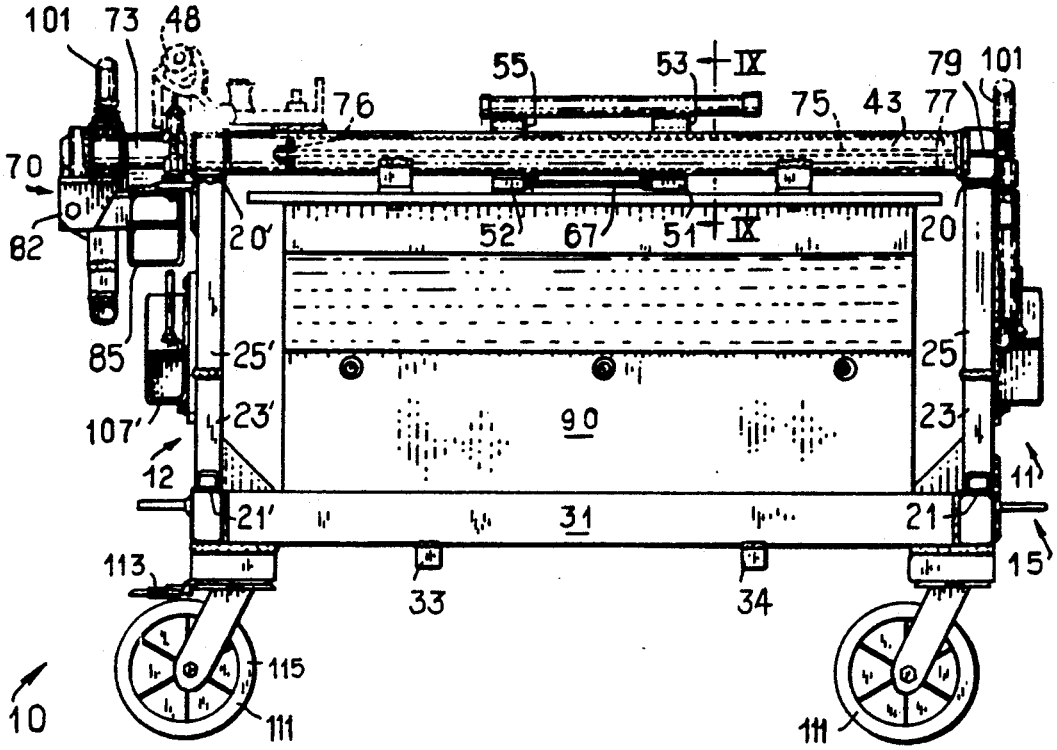
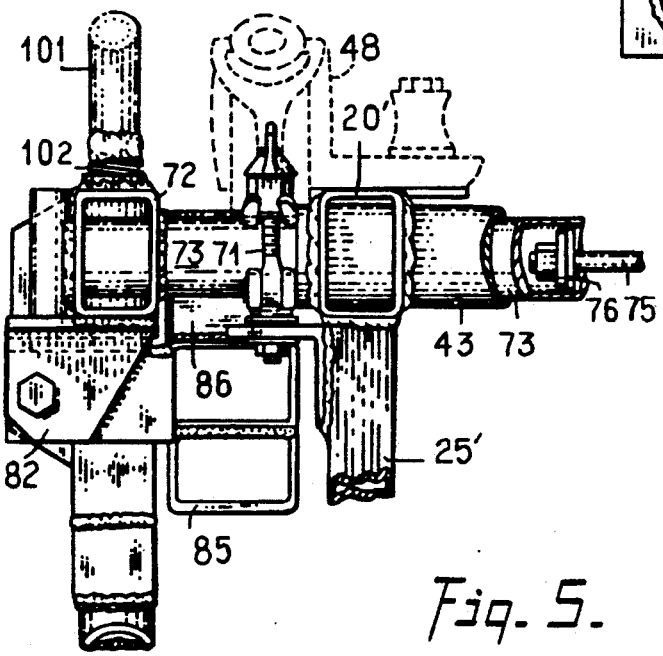
Fig. 5.
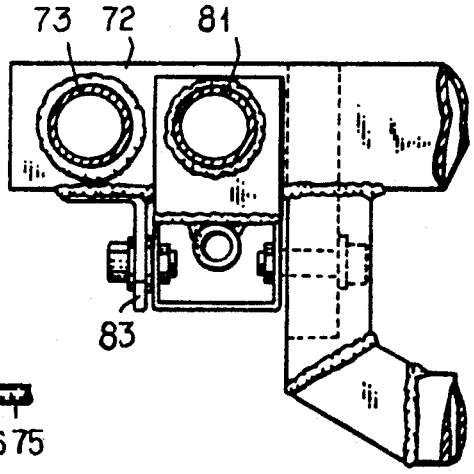
Fig. 6.

MOBILE, EXTENDIBLE TABLE WITH TOOL MOUNT AND CARRIER

BACKGROUND OF THE INVENTION

This invention relates to mobile shops in which the tools needed to do a job, whether in the field or in a section of a building, can easily be brought to a work location. Having a required tool at hand not only saves time on the job but also increases worker morale. Too often, even in factory maintenance work, a large share of the workers time is spent going back and forth from the job site to the tool bin.

Electricians were among the first to realize the importance of having at least their hand tools close at hand. But their tools, being relatively small in size, can be held in a tool pouch. Other workmen must use considerably larger tools to do their jobs. Pipe fitters, for example, need pipe threaders and groovers along with vises and assembly tools to do their work. The prior art for handling such tools and their related workpieces is limited to portable vise tables of simple structure. As a consequence, during the course of a typical job involving pipe fitting, much of the workers' time is spent bringing workpieces and tools together. Indeed, it is estimated that more than 25 percent of their time is so spent just bringing workpieces and tools together.

SUMMARY OF THE INVENTION

It is a primary object of the present invention to provide a combination work bench/workpiece carrier for use in pipe fitting which can be readily moved to a job site so that a greater percentage of a pipe fitter's time can be spent in actual fabrication.

In accordance with the present invention, there is provided a device which can be utilized to bring, in one single trip to the work site, all of a wide range of pipe fitting tools and materials needed to perform a job. The device comprises a table having a pair of asymmetrical endpieces and two sets of telescoping members. Each set of telescoping members includes a pair of fixed tubes and a pair of movable tubes, each of which is slidable within one of the fixed tubes. Each endpiece includes two pairs of horizontal bars, the upper horizontal bar being disposed along the top of the table. The fixed tubes are rigidly attached to the upper horizontal bar in each endpiece. The arrangement of the fixed tubes is such that they are aligned approximately parallel to each other. Moreover, the uppermost point on any transverse cross-section of ench one of these fixed tubes lies in close proximity to a single imaginary plane which is disposed generally horizontally. Thus the fixed tubes not only serve as housing for the movable tubes but also, together with the upper horizontal bars, form the top of the table.

The movable tubes housed within the two outer fixed tubes are rigidly connected to a support structure. This outer pair of movable tubes and the support structure comprise an extension for the top of the table which can be used to double its length. Stops secured to the endpiece distal the support structure limit the travel of the outer pair of movable tubes so that they cannot be fully withdrawn from the fixed tubes.

The two movable tubes housed within the two inner fixed tubes, on the other hand, can be fully withdrawn. The latter movable tubes are substantially shorter than the two outer movable tubes. Moreover, each of the inner pair of movable tubes is rigidly attached to a bracket pivotally connected to the support structure. Once the movable tubes have been withdrawn from the fixed tubes a sufficient distance, the two inner movable tubes, if not otherwise restrained, will swing free of them. The inner pair of movable tubes can then be rotated downwardly into a vertical position. So rotated, they form legs for the support structure.

The table according to the present invention further comprises an offset frame. The offset frame includes, in addition to the asymmetrical endpieces and the fixed tubes, a pair of horizontal rails. The asymmetrical endpieces, which are so constructed generally as to be mirror images of each other, are disposed at opposite ends of the offset frame. Each lower horizontal bar within the two endpieces is rigidly attached to the pair of horizontal rails, forming with the bars, a rectangular structure. Wheels mounted beneath the four corners of the rectangular structure allow the table to be easily pushed or pulled to a job site.

Each of the asymmetrical endpieces further comprises a brace, a short cross member, and two vertical columns, one of which is substantially shorter than the other. The longer vertical column, which is rigidly connected to both of the horizontal bars within the endpiece, forms an outside corner of the table. The shorter vertical column, on the other hand, is situated near the middle of the table, less than one-half the width of the table from this outside corner. Forming a cantilever to support the end of the upper horizontal bar distal the longer vertical column, the brace extends upwardly from the top of the shorter vertical column. The brace itself is also anchored to the longer vertical column by the short cross member.

Thus the offset frame with its two asymmetrical endpieces has four vertical columns which serve as legs. But these, legs situated as they are to one side of the table, are so positioned that more than one-half of its top is cantilevered, thereby providing a large open area beneath the top. This open area allows for the storage and transport of workpieces that are longer than the table itself. Such workpieces, capable of spanning the distance between the lower horizontal bars, preferably rest on these bars and are secured thereto by load ties.

Moreover, a large tool box can be mounted between the two sets of vertical columns on the side of the table away from the cantilevered portion of the top, without detracting from the large open area.

The degree to which the telescoping members are retracted largely determines the compactness of the table. When fully retracted, the table is a very compact, mobile carrier for tools and workpieces. When fully extended, the table provides sites for several work stations which can be utilized simultaneously.

Moreover, tools mounts for all of the various pieces of equipment needed for the fabrication or installation of a particular type of workpiece are preferably attached to the table. In addition, at least one tool mount assembly which can be utilized to support a variety of tools, each of which is interchangeable with the other, is provided.

In the preferred embodiment, the table further comprises a tool mount assembly which includes a platform supportable between the two inner fixed tubes. This tool mount assembly, which can be utilized to hold a pipe threading and grooving machine or the like, includes a pair of carriage bars and curved flanges which extend outwardly and upwardly from opposite ends of each carriage bar. The curved flanges and the carriage bars are slideable along the upper and lower surfaces, respectively, of the two inner fixed tubes, allowing the tool mount assembly and any machine secured thereto to be moved across the top of the table. Moreover, during fabrication of long workpieces, the platform, which is pivotally connected to the remainder of the tool mount assembly, can be raised so as to move it out of the way. Means including a brace connected to the platform for holding it in a raised position is also provided.

The table according to the present invention further comprises means for mounting pipe vises on the offset frame as well as means connected thereto for receiving workpiece rests. Moreover, the workpiece rest receiving means includes not only supports rigidly attached to the offset frame but also supports attached to holders which are detachably mountable within sockets secured to the offset frame. Furthermore, means connected to the support structure for receiving workpiece rests is included, so that long workpieces of large diameter can be accommodated.

To add to the stability of the table, outriggers are also provided. In the preferred embodiment, these outriggers are detachably mounted within sockets in the frame. They not only stop the tendency of the table to roll during use but also allow the table to be used on uneven surfaces. The outriggers can be stored on a shelf within the table when they are not in use.

BRIEF DESCRIPTION OF THE DRAWINGS

FIG. 4 is an elevational view of the material carrier side of the table according to FIG. 1 when the telescoping members are in the fully retracted position;

FIG. 5 is a side elevational view on an enlarged scale of a fragmentary section of the table according to FIG. 1;

FIG. 6 is a cross section VI—VI according to FIG. 5;

DETAILED DESCRIPTION OF THE PREFERRED EMBODIMENT

Figure 1:
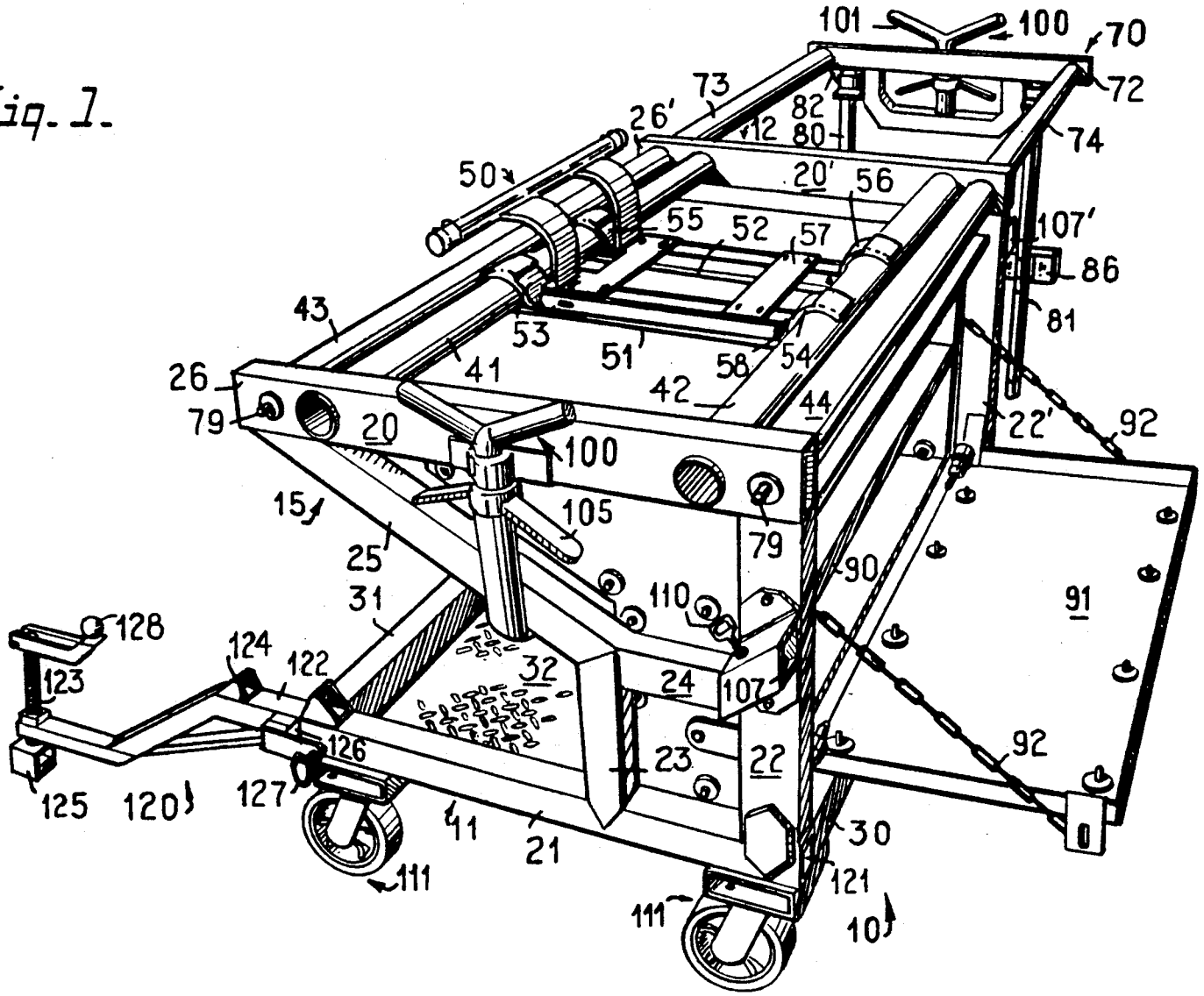
FIG. 1 is an perspective view of the mobile-extendible table according to the present invention with the telescoping members in the extended position, with the tool box opened and with one outrigger in place.

Referring more particularly to the drawing, a mobile, extendible table according to the present invention is indicated generally by the reference numeral 10. The table 10 is small enough to allow it to be easily rolled to a job site and compact enough to allow it to be taken even on small elevators. Indeed, the table 10 is sufficiently compact and mobile that can be moved from job to job in a typical one-half ton pickup truck or in a small trailer and unloaded by one man.

In its compact configuration, the table 10 has an overall size which measures, by way of example, 56 inches in length, 30 inches in width, and 36 inches in height. The table 10 so dimensioned can be moved through 32 inch doors, transported in 5 foot capacity elevators and utilized at a convenient 36 inch workbench height. At the same time, table 10 is readily extendible at a job site so that the table can be utilized to support large workpieces during fabrication.

Figure 2:
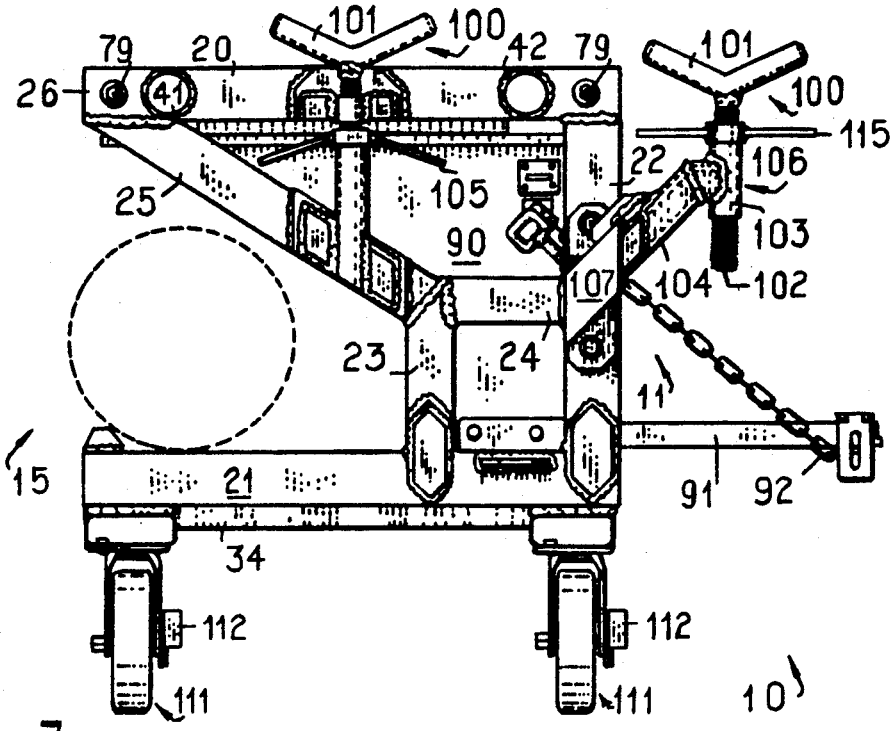
FIG. 2 is an elevational view of the non-extendible end of the table according to FIG. 1.

The table 10 comprises an offset frame, indicated generally by the reference numerical 15, which has asymmetrical endpieces indicated by the reference numerals 11, 12. The endpiece 11 includes upper and lower bars 20 and 21, respectively, which are disposed generally horizontally. The bars 20, 21 are rigidly connected by welding or the like to a vertical column 22 and a bracing structure comprising a shortened vertical column 23, a cross member 24 and a brace 25 (FIG. 2). From its juncture with the shortened vertical column 23 and the cross member 24, the brace 25 extends upwardly to the end 26 of the upper bar 20. The endpiece 12 is basically a mirror image of the endpiece 11. Accordingly, components of the endpiece 12 which correspond to similar components of the end piece 11 have been denoted by primed numerals in the drawings.

In the preferred embodiment, the endpieces 11, 12 are fabricated from rectangular steel tubing which measures by way of example 2 inches by 3 inches and has a wall thickness of approximately ⅛ inch. As illustrated in FIGS. 1 and 4, the lower bars 21, 21' of the endpieces 11, 12 are rigidly attached by welding or the like to a pair of rectangular rails 30, 31. The rails 30, 31, which are disposed approximately parallel to each other and have approximately the same length, form a rectangular structure with the bars 21, 21'. A sheet metal floor 32 is preferably supported by framing members 33, 34 affixed to the rails 30, 31.

As illustrated in FIG. 1, each of the upper bars 20, 20' of the endpieces 11, 12 is rigidly attached by welding or the like to four circular tubes 41, 42, 43, 44 that are aligned approximately parallel to each other. The inner set of tubes 41, 42 is utilized as a carriage for a tool mount assembly 50 comprising a pair of carriage bars 51, 52 to each of which is attached a pair of curved flanges 53, 54; 55, 56, respectively. Bearing surfaces **53*a*, 54*a*, 55*a*, 56*a*, which in the preferred embodiment are made of teflon or the like, are present on the undersides of the curved flanges to facilitate sliding the assembly 50 along the tubes 41, 42**.

Figure 9:
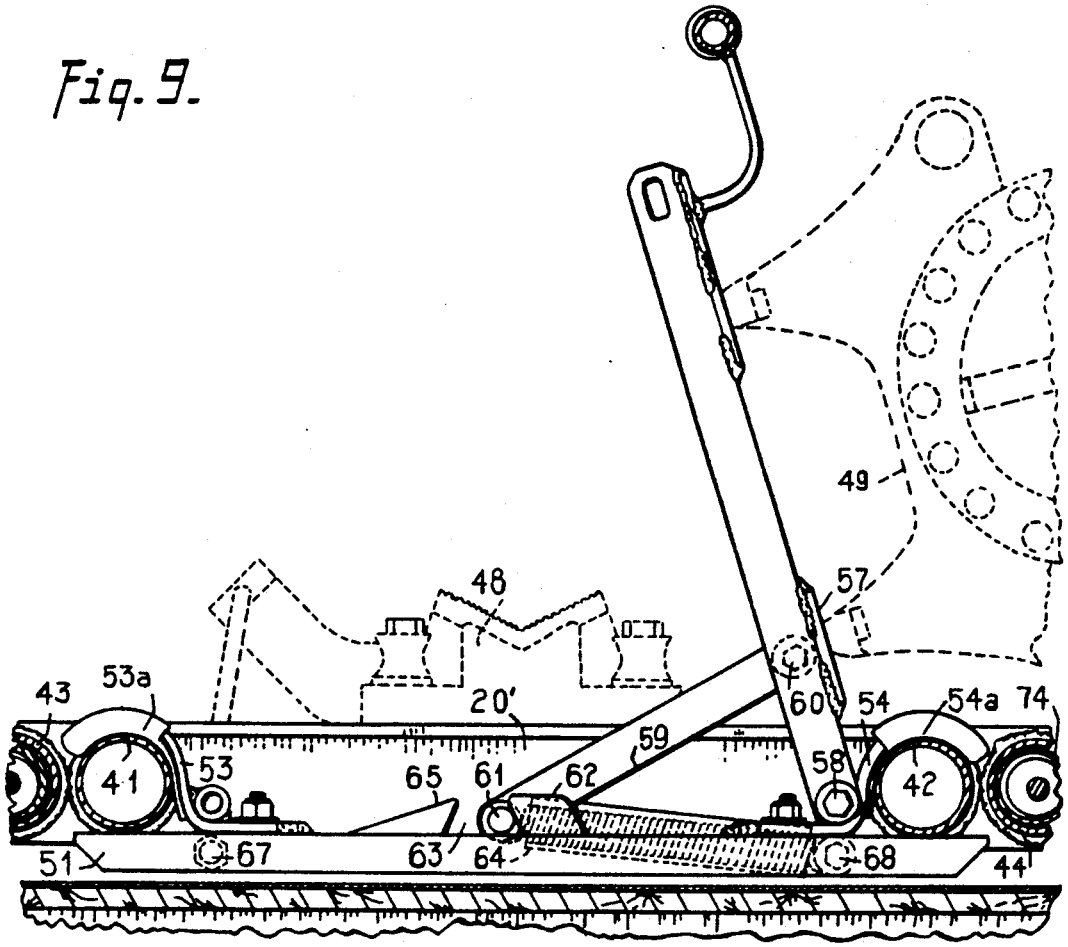
FIG. 9 is an elevational view on an enlarged scale of a fragmentary section of the table according to FIG. 1 showing the tool mount assembly with the platform in the raised position.
Figure 10:
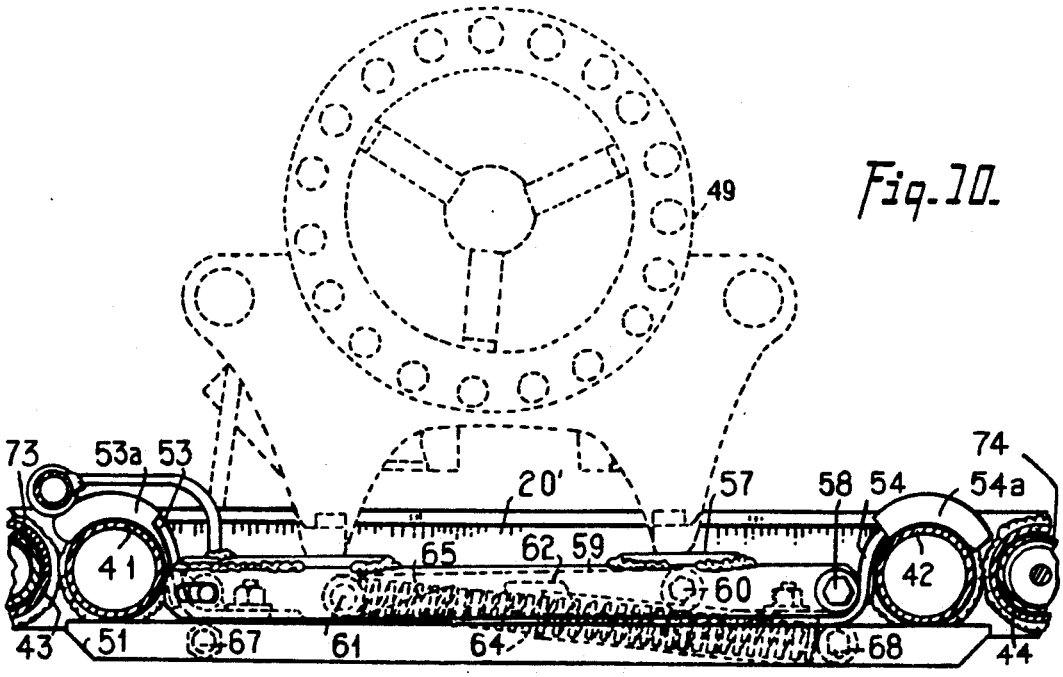
FIG. 10 is an elevational view on an enlarged scale of a fragmentary section of the table according to FIG. 1 showing the tool mount assembly with the platform in the working position.

As shown in FIG. 9, the tool mount assembly 50 further comprises a platform 57 on which a tool 49 can be mounted. The platform 57 is pivotally connected to each of the carriage bars 51, 52 by a pin 58, allowing the platform to be rotated upwardly. When the platform 57 is so raised, the top of the table 10 can be utilized to support long workpieces without interference from any tool which might be mounted on the platform. The pivotal connections between the platform 57 and the bars 51, 52 as well as a spacer rod 67 detachably connected to the bars hold them approximately parallel to each other.

In addition, the tool mount assembly 50 comprises means for holding the platform 57 in a raised position.

The holding means includes a shaft 61, a pair of stops 62, a pair of extension springs 64, and a pair of braces 59. Each of the braces 59 is pivotally connected to the platform 57 by a pin 60; and each of the springs 64 is attached to the shaft 62 and, by a bolt 68, to one of the carriage bars 51, 52. While the platform 57 is being rotated upwardly, the shaft 62 slides up the ramp 65 and then automatically drops into an open slot 63 there. As the shaft 62 is dropping into the slot 63, the shaft is pulled and then held against a stop 62 by the spring 64. The spring 64 also supports a portion of the load of the tool 49 both upon raising and upon lowering the platform 57. But as a safety feature, the shaft 61 must be manually lifted out of the open slot 63 and past the upper edge of the ramp 65 before the platform 57 can be lowered.

As illustrated in FIGS. 1, 4, 5 and 7, the table 10 also includes a pair of movable tubes 73, 74. A support structure 70 with a horizontal bar 72 is rigidly attached to one end of each of the tubes 73, 74. Once a pair of clamps 71 holding each of tubes 73, 74 in place is released, the bar 72 can be pulled away from the endpiece 12, exposing the tubes 73, 74. The exposed ends of the tubes 73, 74, together with the support structure 70, form an extension for the table 10.

In order to prevent the extension tubes 73, 74 from being totally withdrawn from the tubes 40, 43, stops 79 are provided. Each stop 79 comprises a long threaded rod 75 one end of which bolted to the endpiece 11 and the other end to a large washer 76. In addition, each stop 79 includes end washers 77, 78 which are welded to the ends of the tubes 73, 74, respectively. In the assembled table 10, a rod 75 is inserted through the hole in each of the washers 77, 78. When the tubes 73, 74 are fully extended, the washers 76 abut the washers 77, 78, thus preventing the tubes 73, 74 from being withdrawn any further.

Legs 80, 81 are provided to stabilize and add strength to the extension formed by the tubes 73, 74 and support structure 70. The legs 80, 81, like the tubes 73, 74, are stored in a horizontal position. As the tubes 73, 74 are being withdrawn, movable tubes housed within the tubes 41, 42, respectively, are withdrawn simultaneously. The latter pair of movable tubes form the legs 80, 81. The legs 80, 81 are pivotally connected to the bar 72 by brackets 82, 83 (FIGS. 5–8). To prevent the legs 80, 81 from dropping downwardly in an unrestrained manner as the bar 72 is pulled away from the endpiece 12, each of the hinges 82, 83 is immobilized by a slide pin 84. The pins 84 hold the legs 80, 81 in a generally horizontal position. When the pins 84 have been withdrawn, the legs 80, 81 are free to rotate. With the legs 80, 81 rotated perpendicularly to the top of the table 10, the slide pins can then be replaced locking the legs in the vertical position.

Figure 7:
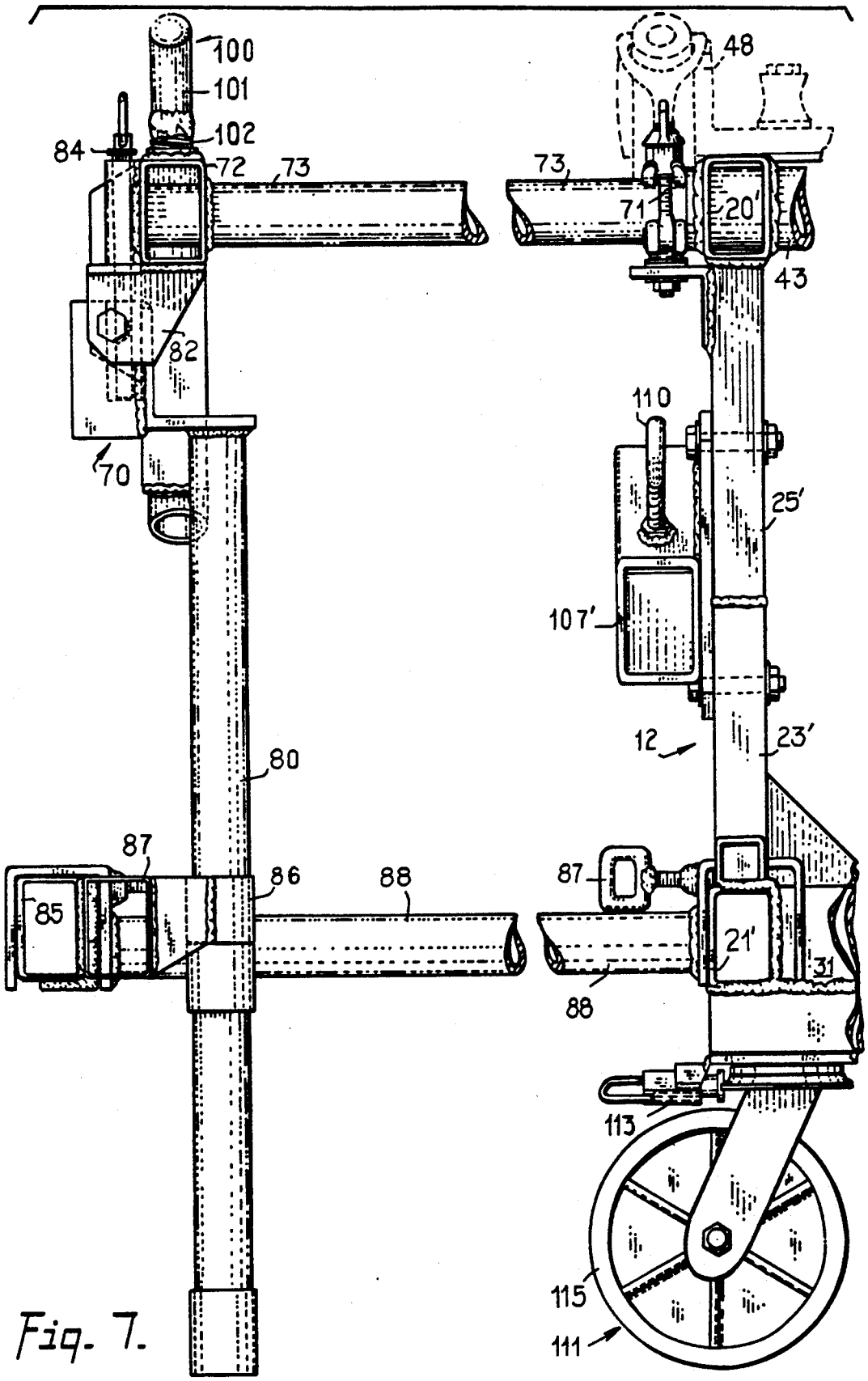
FIG. 7 is an end elevational view of a fragmentary section of the table according to FIG. 1 with the telescoping members in the extended position.
Figure 8:
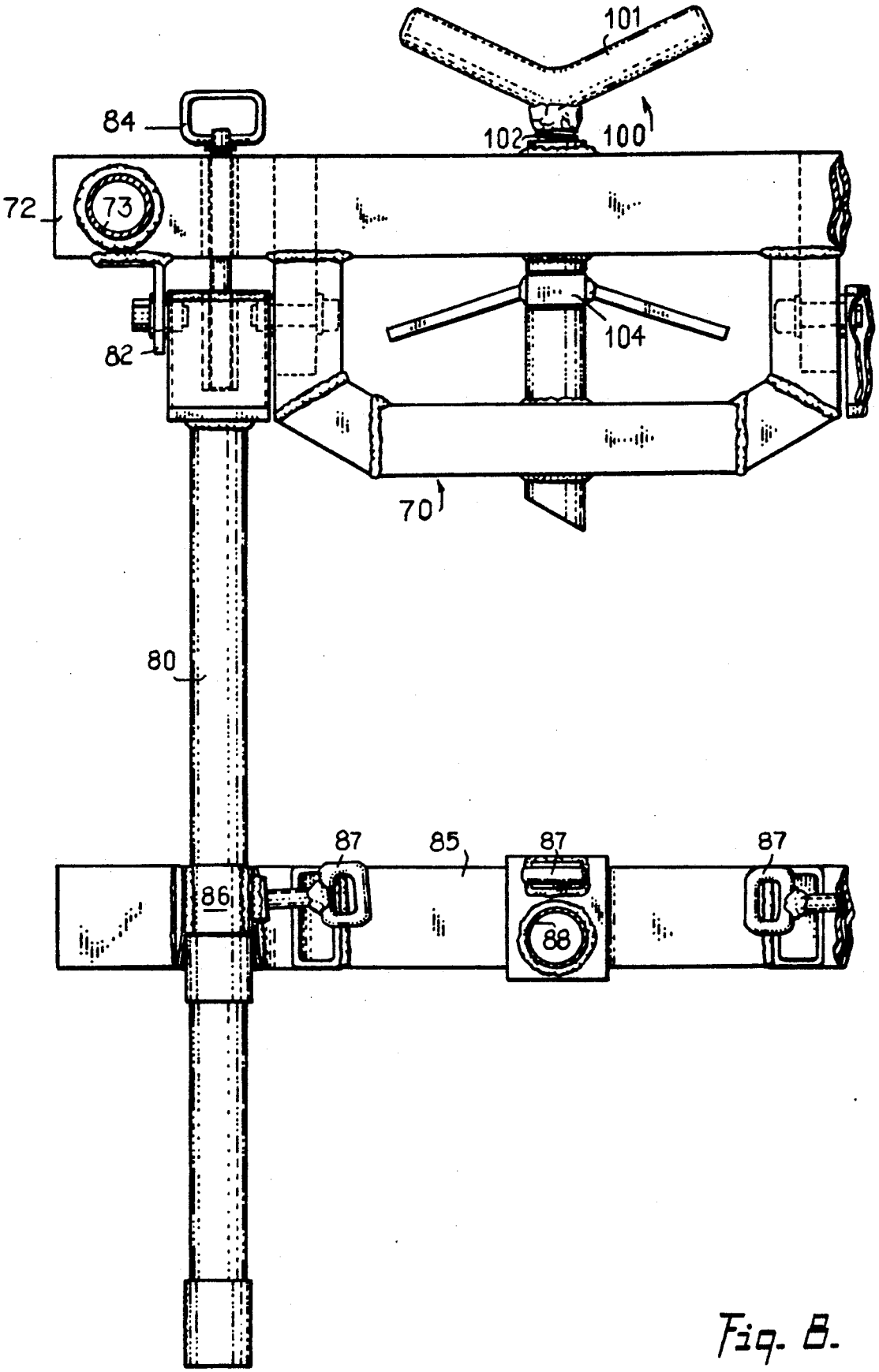
FIG. 8 is a cross section VIII—VIII according to FIG. 7.

In the preferred embodiment, the legs 80, 81 are strengthened by a cross brace 85 slideably attached thereto by a pair of collars 86. Each collar can be locked in place by a pinch bolt 87. To make the extension of the table 10 rigid, a connecting brace 88 is clamped to the cross brace 85 and the lower bar 21' (FIG. 7).

The table 10 further comprises a large tool box 90 with a door 91, which is reinforced. When opened and braced by a pair of chains 92, the door 91 can be utilized as a step (FIGS. 1 and 2). The tool box 90 occupies space between the two pairs of vertical columns 22, 23; 22', 23' which could not be utilized for hauling long workpieces because of space limitations created by the presence of the columns.

Figure 3:
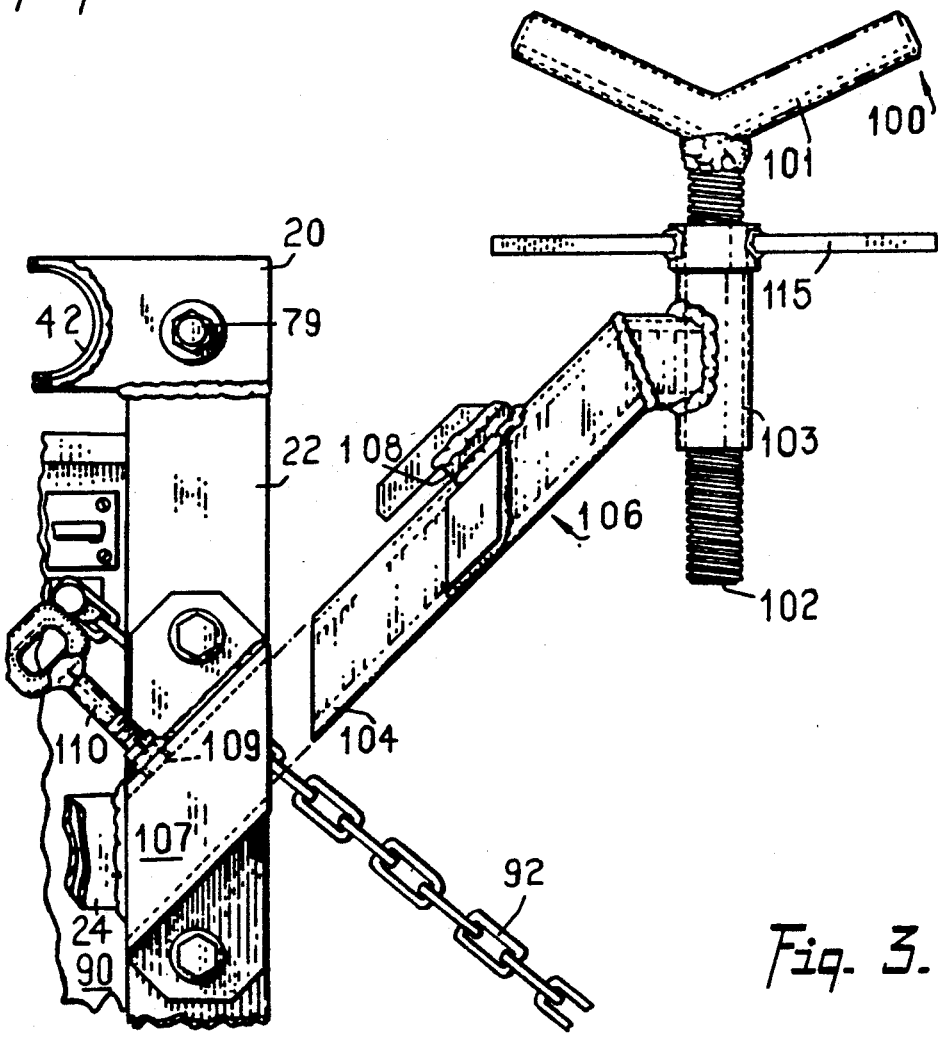
FIG. 3 is an exploded view on an enlarged scale of a fragmentary section of the non-extendible end according to FIG. 2 and of an auxiliary workpiece rest which is detachably mountable on the table.

Further, in the preferred embodiment, at least one auxiliary workpiece rest is detachably mounted within a holding socket 107 rigidly attached to each of the longer vertical columns 22, 22'. As illustrated in FIG. 3, a workpiece rest 100 comprises a V-shaped bar 101 that is rigidly attached to a threaded shaft 102. The height of the V-shaped bar 101 can be adjusted by rotating a bar 115 which is threadedly engageable with the shaft 102 and rests atop a holder 106. The holder 106 includes a tube 103, into which the shaft 102 is slideably insertable, and a holding bar 104. The dimensions of each transverse cross-section of the holding bar 104 below a stop 108 affixed thereto are slightly smaller than those of any similar cross-section of an opening in the holding socket 107. As a consequence, the holding bar 104 can be slideably inserted into the socket 107. The stop 108 prevents the holding bar 104 from falling through the holding socket 107. Moreover, the socket 107 has a threaded hole 109 formed therein for threadedly engaging a locking bolt 110.

For convenience in moving a table 10, four casters 111 mounted on the underside of the offset frame 15 are provided. Each of these casters comprises a wheel 115 and means including a lock 113 for preventing any pivoting of the wheel axially. The use of the lock 113 helps to give the table 10 a straight roll. The casters 111 are also equipped with brakes 112 which can be set to prevent the table 10 from rolling.

To increase the stability of the table 10 when it is resting on uneven ground or simple to keep the table from moving, outriggers, indicated generally by the reference numeral 120, are provided. Each outrigger 120 includes a branched member 122, one end of which can be inserted into the open ends 121, 121' of the lower bars 21, 21'. In the preferred embodiment, the branched member 122 measures, by way of example, $2\frac{1}{2}$inch$\times 1\frac{1}{2}$ inch and is made from rectangular tubing stock with an $\frac{1}{8}$ inch wall thickness. The branched member 122 easily fits into the open ends 121, 121' of the bars 21, 21' which measure, by way of example, $2\frac{3}{4}\times 1\frac{3}{4}$ inches. Each outrigger 120 is also equipped with a locking bolt 127 and a stop 126, which is similar to the stop 108. Further, each outrigger 120 can be adjusted in height by turning a jack screw 123 with a handle 128 to either raise or lower a foot 125. As an added safety feature, the branched member 122 has a riser 124 to keep round workpieces from rolling off the outrigger 120.

It is apparent from the foregoing that a new and improved a mobile fabrication shop has been provided. While only the presently preferred embodiment of the invention has been disclosed, as will be apparent to those familiar with the art, certain changes and modifications can be made without departing from the scope of the invention as defined by the following claims.

It is claimed:

1. A mobile table comprising a frame having end pieces disposed generally vertically at opposite ends thereof; and at least two telescoping members, each telescoping member including a movable tubular member and a fixed tubular member within which the movable tubular member is slideable, the fixed tubular members being rigidly attached to the end pieces and disposed approximately parallel to each other and generally horizontally; at least two movable tubular members remaining approximately parallel to the fixed tubular members when the telescoping members are fully extended.

2. A mobile table according to claim 1 which further comprises a support structure and in which at least two movable tubular members are further characterized as being pivotally connected to the support structure, the movable tubular members so pivotally connected being rotatable perpendicularly to form legs for the support structure when the telescoping members are fully extended.

3. A mobile table according to claim 1 wherein the end pieces are further characterized as being asymmetrical and wherein each asymmetrical endpiece further comprises a pair of bars of approximately equal length, two columns of unequal lengths, a short cross member and a brace; the bars being spaced apart from each other and disposed generally horizontally; the longer column being rigidly connected to both of the bars and disposed perpendicularly thereto, the longer column forming an outside corner of the table; the shorter column being disposed approximately parallel to the longer column and being situated less than one-half the width of the table from said outside corner; the brace extending upwardly from the shorter vertical column to points on one of the bars which are distal from the longer column, the brace being anchored to the longer column by the short cross member, the asymmetrical endpieces being positioned with both of the longer columns on one side of the table, so that the side of the table opposite the longer columns is open, free of obstructions.

4. A mobile table according to claim 3 which further comprises a tool box which is mounted beneath the fixed tubular members, and which is contiguous with the asymmetrical endpieces, each side of the tool box which is contiguous with one of the endpieces having approximately the same size and shape in outline as a typical vertical cross-section of the contiguous endpieces when said cross-section is taken along an imaginary plane disposed perpendicularly to the fixed tubular members.

5. A mobile table according to claim 4 wherein the tool box is further characterized as having a pivotally mounted cover, the cover being usable as a low scaffold.

6. A mobile table according to claim 3 which further comprises a holder; a workpiece rest slideably connected thereto; means for supporting the holder, supporting means including a socket rigidly attached to one of the endpieces, the holder being slideably engageable with the socket; and means for locking the holder in place when it is mounted within the socket.

7. A mobile table comprising:

(a) a pair of asymmetrical endpieces disposed generally vertically at opposite ends of the table;

(b) a support structure; and (c) two sets of telescoping members each set including at least one fixed tubular member and one movable tubular member which is slideable therewithin; the fixed tubular members being aligned approximately parallel to each other and rigidly attached to both of the endpieces; each movable tubular member within one set of telescoping members remaining approximately parallel to the fixed tubular members when the telescoping members are fully extended; each movable tubular member within the other set of telescoping members being pivotally connected to the support structure, the movable tubular members so pivotally connected being rotatable perpendicularly to form legs for the support structure when the telescoping members are fully extended.

8. A mobile table according to claim 7 which further comprises means for locking each movable member in place when the telescoping members are fully extended.

9. A mobile table according to claim 8 wherein the locking means further comprises a pin and a pair of tubes, the pin being slideably insertable within the tubes; one of the tubes being rigidly attached to the support structure and the other tube being rigidly attached to one of the movable tubular members which is pivotally connected to the support structure; the longitudinal axes of the tubes being aligned when the movable tubular members so pivotally connected have been rotated perpendicularly to the fixed tubular members, so that the pin can be inserted into the tubes.

10. A mobile table comprising:

(a) at least one pair of rails which are disposed generally horizontally and approximately parallel to each other; and (b) a pair of asymmetrical endpieces disposed generally vertically, each endpiece having a pair of bars of approximately equal length which are disposed generally horizontally and approximately parallel to each other; one bar of each endpiece being rigidly attached to both rails, so that the bars and rails form a rectangular structure; each end piece also having two columns of unequal lengths, a short cross member and a brace; the bars being spaced apart from each other and disposed generally horizontally; the longer column being rigidly, connected to both of the bars and disposed perpendicularly thereto, the longer column forming an outside corner of the table; the shorter column being disposed approximately parallel to the longer column and being situated less than one-half the width of the table from said outside corner; the brace extending upwardly from the shorter vertical column to one end of the bars which is distal the longer column, the brace being anchored to the longer column by the short cross member, the asymmetrical endpieces being positioned with both of the longer columns on one side of the table, so that the opposite side of the table is open, free of obstructions.

11. A mobile table according to claim 10 which further comprises a tool box which is contiguous with the asymmetrical endpieces, each side of the tool box which is contiguous with one of the endpieces having approximately the same size and shape in outline as a typical vertical cross-section of the contiguous endpieces when said cross-section is taken along an imaginary plane disposed perpendicularly to the fixed tubular members.

12. A mobile table according to claim 11 wherein the tool box is further characterized as having a pivotally mounted cover, the cover being usable as a low scaffold.

13. A mobile table according to claim 10 which further comprises a holder; a workpiece rest slideably connected thereto; means for supporting the holder, supporting means including a socket rigidly attached to one of the endpieces, the holder being slideably engageable with the socket; and means for locking the holder in place when it is mounted within the socket.

14. A mobile table according to claim 13 wherein each of said bars which are attached to the rails to form the rectangular structure are further characterized as having an open end, and which further comprises an outrigger with a branched member, one end of the branched member being slideably engageable with each of the open ends of the bars; the outrigger having means including a screw jack threadedly engageable with the branched member for adjusting the height thereof.

15. A mobile table according to claim 10 which further comprises:

(a) a support structure; and (b) two sets of telescoping members each set including at least one fixed tubular member and one movable tubular member which is slideable therewithin the fixed tubular members being aligned approximately parallel to each other and rigidly attached to both of the endpieces; each movable tubular member within one set of telescoping members remaining approximately parallel to the fixed tubular members when the telescoping members are fully extended; each movable tubular member within the other set of telescoping members being pivotally connected to the support structure, the movable tubular members so pivotally connected being rotatable perpendicularly to form legs for the support structure when the telescoping members are fully extended.

* * * * *